US008991409B2

(12) United States Patent
Guimaraens et al.

(10) Patent No.: US 8,991,409 B2
(45) Date of Patent: Mar. 31, 2015

(54) UMBRELLA CASE

(76) Inventors: Irene Guimaraens, New York, NY (US); Florencia Kaufmann, New York, NY (US)

( * ) Notice: Subject to any disclaimer, the term of this patent is extended or adjusted under 35 U.S.C. 154(b) by 152 days.

(21) Appl. No.: 13/607,182

(22) Filed: Sep. 7, 2012

(65) Prior Publication Data

US 2013/0061891 A1 Mar. 14, 2013

Related U.S. Application Data

(60) Provisional application No. 61/532,411, filed on Sep. 8, 2011.

(51) Int. Cl.
*A45B 25/24* (2006.01)
*A45B 25/28* (2006.01)

(52) U.S. Cl.
CPC ..... *A45B 25/24* (2013.01); *A45B 25/28* (2013.01)
USPC ..... 135/34.2; 135/16; 224/251; 283/75; 283/113

(58) Field of Classification Search
USPC ..... 135/16, 18, 34.2; 224/407–409, 915, 224/251, 258, 613; 150/131, 154; 383/75, 383/113
See application file for complete search history.

(56) References Cited

U.S. PATENT DOCUMENTS

| | | | | | |
|---|---|---|---|---|---|
| 1,031,361 | A * | 7/1912 | Mitchell | 135/34.2 |
| 1,861,061 | A * | 5/1932 | Maxwell, Jr. | 135/34.2 |
| 1,891,184 | A * | 12/1932 | Salomon | 135/34.2 |
| 2,028,337 | A * | 1/1936 | Lane | 211/63 |
| 3,799,227 | A * | 3/1974 | Cantwell | 224/613 |
| 4,558,807 | A * | 12/1985 | Jackson | 224/251 |
| 5,161,656 | A * | 11/1992 | Brenner | 190/111 |
| 6,533,298 | B2 * | 3/2003 | Sims | 280/47.26 |
| 6,634,531 | B2 * | 10/2003 | Conte | 224/407 |
| 2006/0289044 | A1 * | 12/2006 | Benett | 135/16 |
| 2007/0251557 | A1 * | 11/2007 | Carter et al. | 135/25.4 |
| 2011/0030746 | A1 | 2/2011 | Uniyal et al. | |
| 2013/0048693 | A1 * | 2/2013 | Chin | 224/600 |

FOREIGN PATENT DOCUMENTS

| | | | | | |
|---|---|---|---|---|---|
| CN | 201518830 | | | 7/2010 | |
| CN | 201518830 | U | | 7/2010 | |
| DE | 08262010 | A1 | | 8/2010 | |
| DE | 102009009410 | A1 | | 8/2010 | |
| GB | 2226948 | | | 7/1990 | |
| GB | 2226948 | A | * | 7/1990 | A45C 11/00 |
| JP | 08038227 | A | * | 2/1996 | A45B 25/24 |
| JP | 2000300321 | A | * | 10/2000 | A45B 25/24 |
| JP | 2005312800 | A | * | 11/2005 | A47G 25/12 |
| JP | 2007167595 | A | * | 7/2007 | A45B 25/24 |
| RU | 91508 | | | 2/2010 | |
| RU | 91508 | U1 | | 2/2010 | |

* cited by examiner

*Primary Examiner* — Winnie Yip
(74) *Attorney, Agent, or Firm* — Stuart J. West; Shaun N. Sluman; West & Associates, A PC

(57) ABSTRACT

An umbrella case comprising a pouch having a bottom end and a top end, such that a collapsed umbrella can be inserted into the pouch through an aperture in the top end, an enclosure member configured to selectively close the aperture of the top end, and one or more connecting members configured to be selectively coupled with components of a stroller or other device. The pouch can have corresponding fasteners that can be selectively coupled with one another to adjust the length of the pouch.

15 Claims, 6 Drawing Sheets

UMBRELLA CASE

CLAIM OF PRIORITY

This Application claims priority under 35 U.S.C. §119(e) from earlier filed U.S. Provisional Application Ser. No. 61/532,411, filed Sep. 8, 2011, the entirety of which is incorporated herein by reference.

BACKGROUND

1. Field of the Invention

The present device relates to the field of umbrella cases, particularly umbrella cases configured to be coupled with strollers or other devices.

2. Background

Parents and guardians often place young children in strollers when they desire to transport the children while shopping, running errands, visiting a park, walking around, or doing any other type of activity. The parents or guardians can desire to be prepared for a change in weather and wish to bring an umbrella along with them. However, umbrellas can be inconvenient to bring along in many situations, as umbrellas are often of a shape that is difficult to pack away in most bags or storage containers. Additionally, umbrellas can be wet after being used and can undesirably transfer water to other items unless the umbrella is kept apart from the other items. The parent or guardian can therefore desire a device that can store an umbrella when it is not raining or can store a wet umbrella when it stops raining or the parent or guardian goes indoors.

Some umbrella bags and cases exist, but generally they must be carried separately. This can be inconvenient when a parent or guardian must also push a stroller. Some devices exist that can couple the handle of an umbrella to a stroller, such that the parent or guardian can be under the umbrella's canopy while the stroller is in use. However, these devices do not store the umbrella when not in use, and do not prevent water from being transferred to other items when the umbrella is collapsed.

What is needed is an umbrella case configured to be selectively coupled with a stroller. The umbrella case can be waterproof or water resistant, such that water from a wet umbrella inside the case is not transferred to the stroller or other items. In some embodiments, the umbrella case can also be selectively coupled with other movable and/or stationary devices, such as wheelchairs, bicycles, shopping carts, benches, or other devices.

DETAILED DESCRIPTION

Figure 1A:
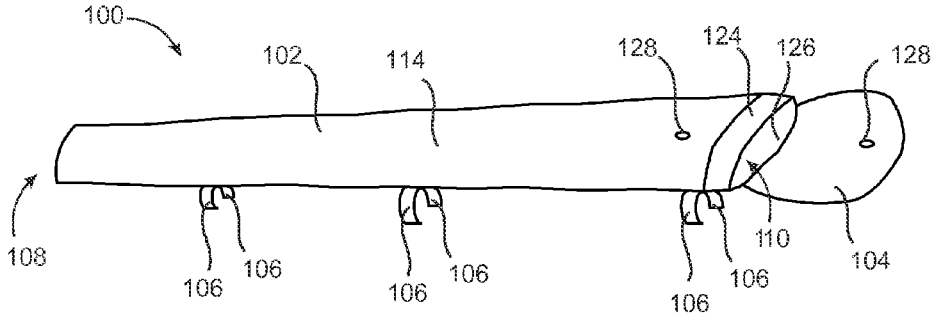
FIG. 1*a* depicts an isometric view of the top of an embodiment of an umbrella case.
Figure 1B:
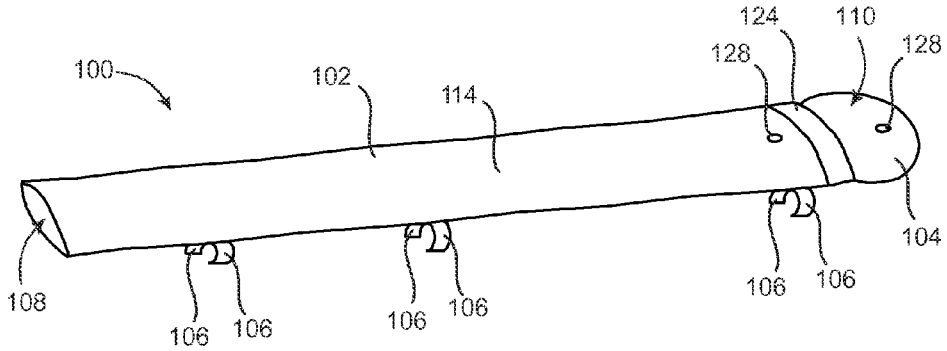
FIG. 1*b* depicts an isometric view of the bottom of an embodiment of an umbrella case.

FIG. 1*a* depicts an isometric view of the top of an embodiment of an umbrella case 100. FIG. 1*b* depicts an isometric view of the bottom of an embodiment of an umbrella case 100. An umbrella case 100 can comprise a pouch 102, an enclosure member 104, and one or more connecting members 106. The pouch 102 can be an elongated receptacle having a bottom end 108 and a top end 110. In some embodiments, the bottom end and the top end can each define an aperture that opens into the interior of the pouch 102. The pouch 102 can have a transverse cross section with dimensions greater than the dimensions of the transverse cross section of a collapsed umbrella, such that a collapsed umbrella can be inserted into the pouch 102 via the top end 110. In some embodiments, the transverse cross section of the pouch 102 can be circular. In other embodiments, the transverse cross section of the pouch 102 can be oval, rectangular, diamond shaped, polygonal, or any other desired shape.

In some embodiments, the length of the pouch 102 between the bottom end 108 and the top end 110 can be greater than the length of a collapsed umbrella, such that the collapsed umbrella can fit entirely within the pouch 102. In alternate embodiments, the length of the pouch 102 between the bottom end 108 and the top end 110 can be longer than a majority of the length of a collapsed umbrella. By way of a non-limiting example, the pouch 102 can have a length such that the pouch 102 can cover the collapsed canopy of the umbrella but the handle of the umbrella can extend out of the top end 110 when the umbrella is inserted into the pouch 102.

Figure 2A:
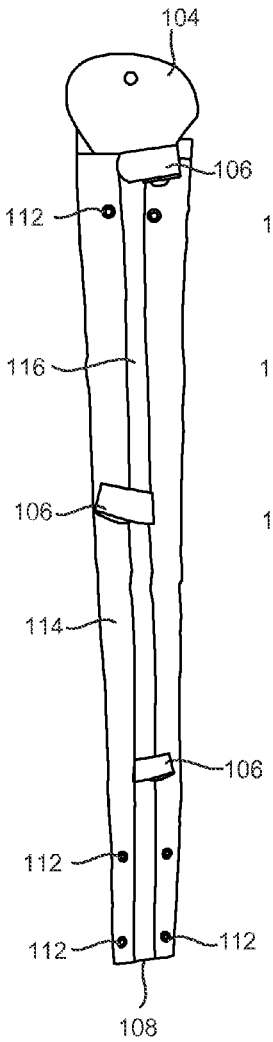
FIG. 2A depicts a back view of an embodiment of an adjustable length umbrella case in an unfolded position.

As shown in FIGS. 2A-2D, in some embodiments the length of the pouch 102 can be adjustable. FIG. 2A depicts a back view of an embodiment of the umbrella case 100 in an unfolded position. A plurality of fasteners 112 can be coupled with the exterior of the pouch 102. The fasteners 112 can be snaps, clips, hook and loop fasteners, buttons, or any other type of fastener. In some embodiments, fasteners 112 can be positioned in predetermined locations on the front and/or back of the pouch 102. The pouch 102 can be folded, rolled, or otherwise manipulated such that at least one fastener 112 can be coupled with another fastener 112 to adjust the length of the pouch 102. When two or more fasteners 112 are coupled together, the pouch 102 can be folded back on itself and the bottom end 108 can be against a side of the pouch 102, such that an umbrella that is inserted through the top end 110 can rest its tip against the walls of the pouch 102 at the fold line or other bend in the walls of the pouch. By selectively coupling different fasteners 112 together, a user can adjust the length of the pouch 102 for different situations. By way of non-limiting examples, in the embodiment shown in FIG. 2B the two lowest sets of fasteners 112 are coupled together to adjust the pouch 102 for long umbrellas, while in the embodiment shown in FIG. 2C the lowest set of fasteners 112 are coupled with the highest set of fasteners 112 to adjust the pouch 102 for short umbrellas and/or umbrellas that collapse into compact packages.

Figure 2B:
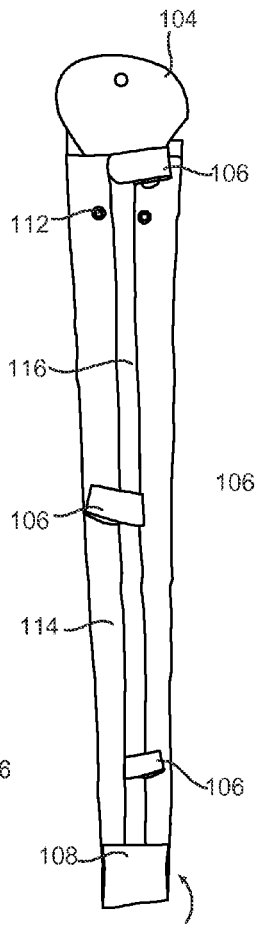
FIG. 2B depicts a back view of an embodiment of an adjustable length umbrella case in a first folded position.
Figure 2C:
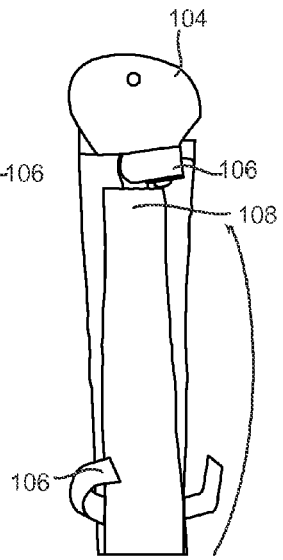
FIG. 2C depicts a back view of an embodiment of an adjustable length umbrella case in a second folded position.
Figure 2D:
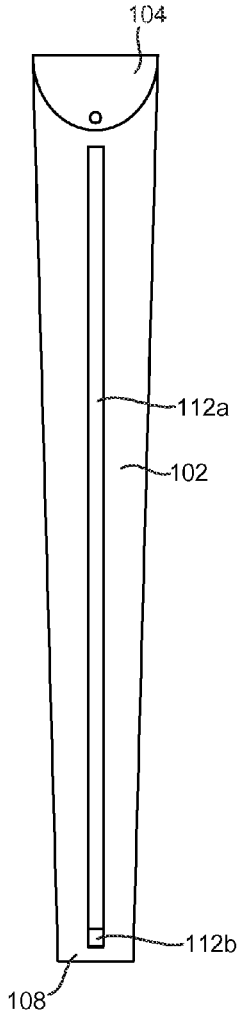
FIG. 2D depicts a front view of an embodiment of an adjustable length umbrella case with a fastener strip in an unfolded position.

In alternate embodiments, one or more of the fasteners 112 can be an elongated strip on the front and/or back of the pouch 102, such as the fastener 112*a* shown in FIG. 2D, and at least one of the other fasteners 112, such as the fastener 112*b* shown in FIG. 2D, can be selectively coupled with any desired location on the elongated strip to adjust the length of the pouch 102 to any desired length.

In some embodiments, the shape of the pouch 102 can be tapered between the top end 110 and the bottom end 108. By way of a non-limiting example, the top end 110 can be wider than the bottom end 108. In other embodiments, the shape of the pouch 102 can be rectangular. In alternate embodiments, the sides of the pouch 102 between the top end 110 and the bottom end 108 can be straight, curved, wavy, or have any other shape.

Figure 3:
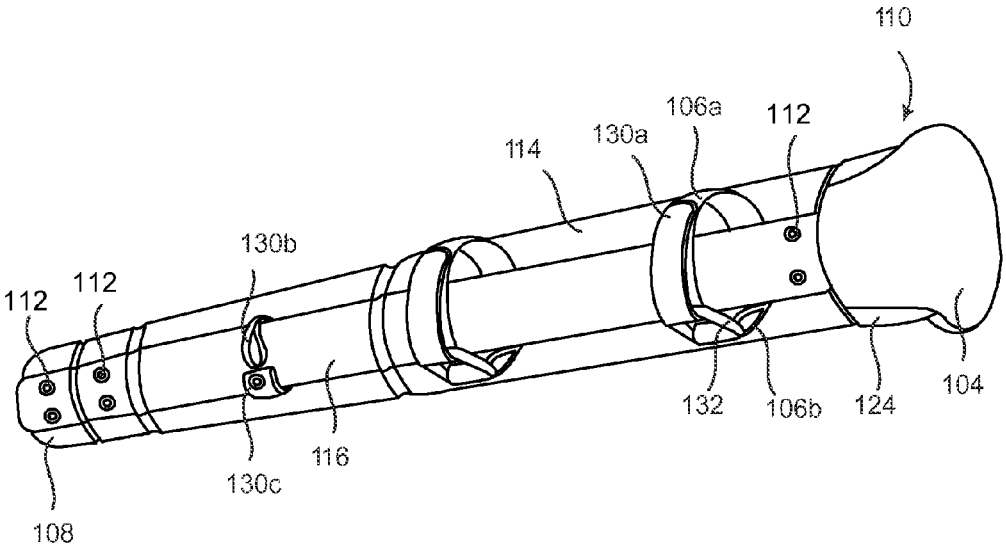
FIG. 3 depicts a rear view of an embodiment of an umbrella case.

FIG. 3 depicts a rear view of an embodiment of the umbrella case 100. The pouch 102 can comprise one or more body sections 114 coupled with one another to define the receptacle of the pouch 102. The body sections 114 can be comprised of plastic, fabric, vinyl, rayon, nylon, laminate, foam, metal, or any other desired material or combination of materials. In some embodiments, the body sections 114 can be flexible. In alternate embodiments, the body sections 114 can be rigid, semi-rigid, or have any combination of rigidities. The body sections 114 can be waterproof or water resistant, and the body sections 114 can be coupled with one another with a water impermeable bond. In some embodiments, the body sections 114 can be sewn to one another. In other embodiments, the body sections 114 can be coupled with one another by adhesives, fusing, bolts, screws, staples, stitching, and/or any other bonding mechanism. In alternate embodiments, the pouch 102 can be formed by a single body section 114 with its edges coupled together. In still other embodiments, the pouch 102 can be a single continuous body section 114 manufactured or knit without seams. In some embodiments, the pouch 102 can have designated fold lines and/or indentations, as shown in FIG. 3. In alternate embodiments, the pouch 102 can be folded, bent, or otherwise manipulated at any point.

In some embodiments, one or more of the body sections 114 can be spinal members 116. Spinal members 116 can be elongated planar members that can extend along the length of the pouch 102 from the bottom end 108 to the top end 110. In some embodiments, spinal members 116 can be thicker, stronger, stiffer, and/or sturdier than the other body sections 114. In some embodiments, the spinal members 116 can comprise a non-stick and/or non-slip material, such that the spinal members 116 can assist in preventing movement between the pouch 102 and a stroller or other object to which the umbrella case 100 is coupled, as discussed below with reference to FIGS. 6 and 7. In some embodiments, the spinal members 116 can be comprised of the same material as other body sections 114. In alternate embodiments, the spinal members 116 can be comprised of wood, metal, plastic, fabric, or any other desired material. In some embodiments, the spinal members 116 can comprise padding.

Figure 4:
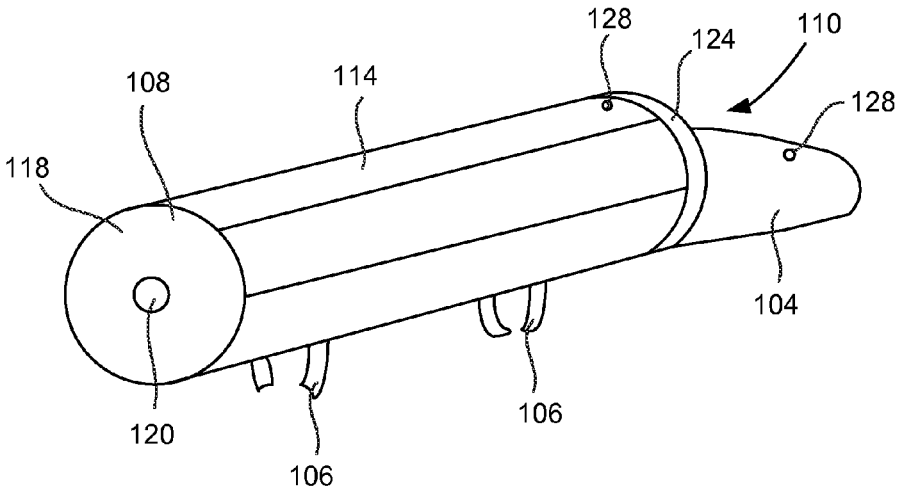
FIG. 4 depicts an isometric view of the bottom of an embodiment of an umbrella case.

FIG. 4 depicts an isometric view of the bottom of an embodiment of the umbrella case 100. While in some embodiments the bottom end can define an aperture that opens into the interior of the pouch 102 as discussed above, in alternate embodiments the body sections 114 can be formed, manufactured, and/or coupled together to form a bottom end 108 that is closed. By way of a non-limiting example, in some embodiments, one or more body sections 114 can form a bottom panel 118 that can extend transversely to the length of the pouch 102 and be coupled with the sides of the pouch 102 to close off and form a closed bottom end 108, as shown in FIG. 4.

Figure 5:
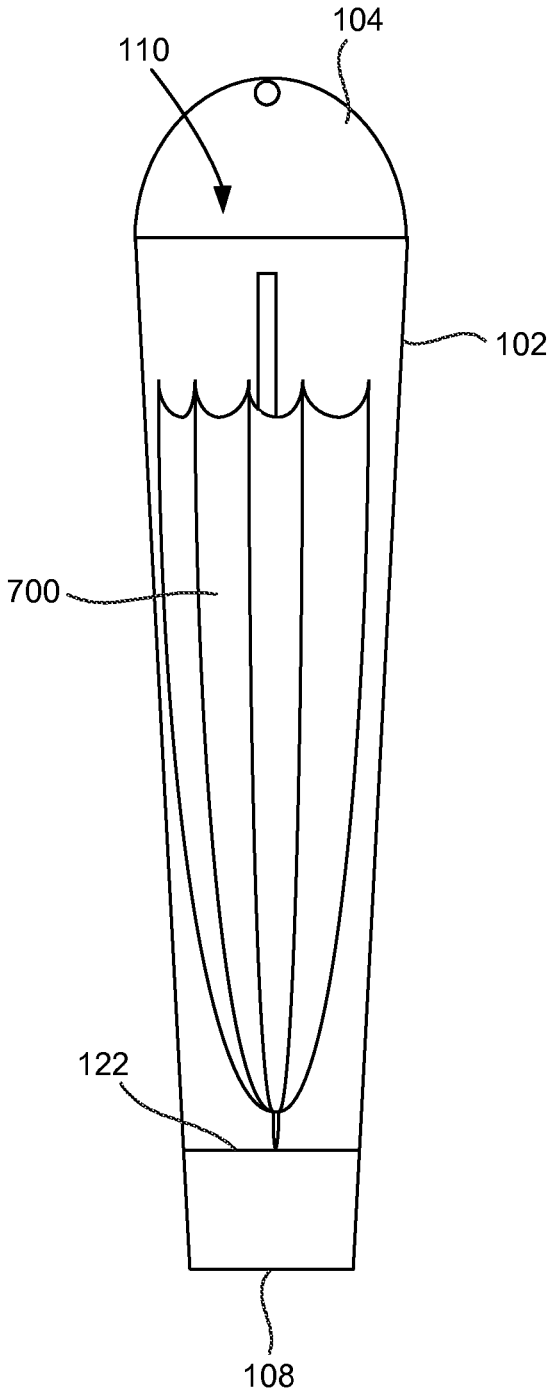
FIG. 5 depicts a cross section of an embodiment of an umbrella case with an inserted umbrella.

In embodiments with an open bottom end 108, water that enters the interior of the pouch 102 can pool within the pouch 102 at the fold line, as shown in FIGS. 2B and 2C. To expel the water, a user can uncouple the fasteners 112 from one another and unfold the pouch 102 or otherwise move the bottom end 108 to the unfolded position shown in FIG. 2A, such that water can flow out of the open bottom end 108. Alternatively, a user can pour water out of the top end 110. In alternate embodiments with a closed bottom end 108, water can pool within the pouch at the bottom end 108. In some of these embodiments, the bottom end 108 can comprise an outlet 120 that can be selectively opened to expel water that has pooled within the pouch 102. The outlet 120 can be a flap, valve, tap, hatch, cap, or any other device that can be selectively opened or operated to expel water. In still other embodiments, a base 122 can be coupled with the interior of the pouch 102 above the bottom end 108, such that the tip of an umbrella 700 can rest on the base 122, as shown in the cross section view depicted in FIG. 5. The base 122 can be permeable, such that water can pass through the base 122 and pool below the base 122 at a closed bottom end 108.

In some embodiments, one or more collar members 124 can be coupled with the pouch 102. In some embodiments, the collar members 124 can be oriented transversely to the length of the pouch 102 at the top end 110, such that they surround and define the aperture of the top end 110. In some embodiments, the collar members 124 can be positioned on the exterior of the pouch 102. In alternate embodiments, the collar members 124 can extend from the exterior of the pouch 102 into at least a portion of the interior of the pouch 102. The collar members 124 can be comprised of plastic, fabric, vinyl, rayon, nylon, laminate, foam, metal, or any other desired material or combination of materials. In some embodiments, the collar members can comprise hook and loop connectors, drawstrings, or other components configured to adjust the length of the collar members 124, such that the diameter of the aperture of the top end 110 can be changed. In other embodiments, the collar members 124 can be absent.

In some embodiments, the pouch 102 can further comprise a lining 126 that extends at least partially into the interior of the pouch 102. In some embodiments, the lining 126 can be an extension of the collar members 124. In other embodiments, the lining 126 can be comprised of one or more separate components that are coupled with the body sections 114. The lining 126 can be comprised of plastic, fabric, vinyl, rayon, nylon, laminate, foam, metal, or any other desired material or combination of materials. In some embodiments, the lining 126 can be waterproof and/or water resistant. In other embodiments, the lining 126 can be comprised of absorbent material, such that the lining 126 can at least partially soak up water from a wet umbrella 700 inserted into the pouch 102. In some embodiments, the lining 126 can be completely or partially removable from the interior of the pouch 102. In other embodiments, the lining 126 can be absent.

The enclosure member 104 can be configured to selectively enclose the aperture of the top end 110. In some embodiments, the enclosure member 104 can be a flap. In other embodiments, the enclosure member 104 can be a cap, cover, or other component configured to cover the aperture of the top end 110. In some embodiments, the enclosure member 104 can be an extension of a collar member 124, a spinal member 116, a body section 114, and/or any other component of the pouch 102. In other embodiments, the enclosure member 104 can be a separate component coupled to the pouch 102 at the top end 110. The enclosure member 104 can be comprised of plastic, fabric, vinyl, rayon, nylon, laminate, foam, metal, or any other desired material or combination of materials. The enclosure member 104 can be positioned and shaped such that the enclosure member 104 can be moved over the aperture of the top end 110, thereby enclosing the interior of the pouch 102. In some embodiments, the pouch 102 can comprise one or more connectors 128 configured to be selectively coupled with one or more corresponding connectors 128 coupled with the exterior of the pouch 102 and/or the collar members 124 when the enclosure member 104 is positioned over the aperture of the top end 110. In some embodiments, the connectors 128 can be snaps. In other embodiments, the connectors 128 can be hook and loop connectors, zippers, buttons, magnets, or any other type of connection mechanism. In some embodiments, the enclosure member 104 can be shaped such that its widest portion is wider than the aperture of the top end 110, such that the enclosure member 104 can prevent water from entering the interior of the pouch when the enclosure member 104 covers the aperture of the top end 110.

In some embodiments, the enclosure member 104 can be absent. In some of these embodiments, the aperture of the top end 110 can be closed with a drawstring, zipper, or other component coupled with the pouch 102 that can close the aperture of the top end 110. In other embodiments, the collar members 124 can comprise spring-loaded and/or biased members that can be moved, squeezed, pressed, or otherwise manipulated to open and/or close the aperture of the top end 110.

The one or more connecting members 106 can be coupled with the exterior of the pouch 102. In some embodiments, the connecting members 106 can be provided in sets, and each member of the set can be configured to selectively mate with the other members of the set. In some embodiments, a plurality of connecting members 106 and/or sets of connecting members 106 can be arranged at positions substantially following a straight line along the length of the pouch 102 between the bottom end 108 and the top end 110. In some embodiments, the one or more connecting members 106 can be coupled with one or more of the spinal members 116, as shown in FIG. 3. In some of these embodiments, one member of a set of connecting members 106 can be coupled with one side of a spinal member 116, and another member of the set of connecting members 106 can be coupled with the other side of the spinal member 116. In alternate embodiments, the one or more connecting members 106 can be coupled with any of the body sections 114. The one or more connecting members 106 can be elongated members. In some embodiments, the connecting members 106 can be strips of fabric. In other embodiments, the connecting members 106 can be string, rope, elastic, straps, ties, belts, or any other elongated body. In some embodiments, each connecting member 106 can comprise one or more fasteners 130. The fasteners 130 can be hook and loop fasteners, snaps, clips, buttons, hooks, loops, protrusions and apertures, buckles, release buckles, locks, or any other type of fastener.

In some embodiments, the connecting members 106 can comprise one or more tightening mechanisms 132. The tightening mechanisms 132 can adjust the position of connecting members 106. Tightening mechanisms 132 can be sliders, brackets, locks, cordlocks, ladder locks, buckles, or any other device that can adjust the position of connecting members 106. In some embodiments, the tightening mechanisms 132 can adjust the position of coupled connecting members 106 relative to one another. In other embodiments, the tightening mechanisms 132 can adjust the length of individual connecting members 106.

Figure 6:
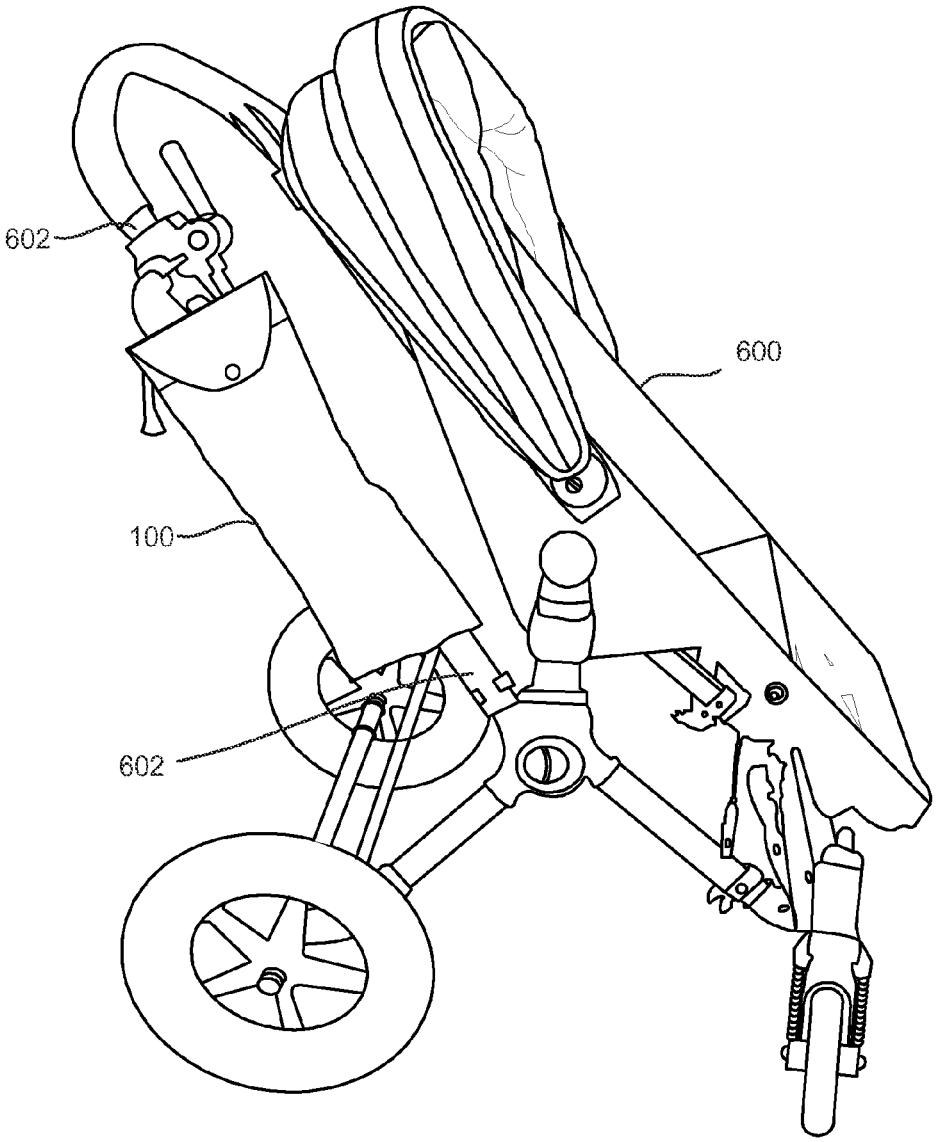
FIG. 6 depicts an embodiment of an umbrella case in use with a stroller.

FIG. 6 depicts an embodiment of the umbrella case 100 in use with a stroller 600. In operation, one or more connecting member 106 can be coupled with one or more components of a stroller 600 or other device. By way of a non-limiting example, many strollers 600 comprise one or more posts 602 that extend along the side of the stroller 600 from the stroller's handle to one or more of its wheels, and the connecting members 106 can be looped around these posts 602 and be tied together or be fastened with the fasteners 130 to couple the pouch 102 with the stroller 600. In some embodiments, when the bottom end 108 is folded up toward the top end 110 and coupled via the fasteners 112, as shown in FIG. 2C, the connecting members 106 can extend around the folded portion of the pouch 102 such that the connecting members 106 can be coupled with the stroller 600 as shown in FIG. 6. In some embodiments, the tightening mechanisms 132 can be operated to tighten or loosen the fit of the connecting members 106 around the components of the stroller 600 components as desired. By way of a non-limiting example, in the embodiment shown in FIG. 3, a first connecting member 106*a* can comprise sections of hook and loop fasteners 130*a*, and a second connecting member 106*b* can comprise a buckle tightening mechanism 132. The first connecting member 106*a* can be passed around a stroller post 602, through the buckle tightening mechanism 132, be pulled tight against the stroller post 602, and be coupled to itself with the hook and loop fasteners 130*a*. Other connecting members 106 can have different types of fasteners 130, such as the loop fastener 130*b* and the button fastener 130*c*. In alternate embodiments, the connecting members 106 can further extend around the exterior of the pouch 102, such that the tightening mechanisms 132 can tighten the connecting members 106 around the body sections 114 to compress the interior of the pouch 102 in addition to tightening the fit of the connecting members 106 around the stroller's posts 602.

Figure 7:
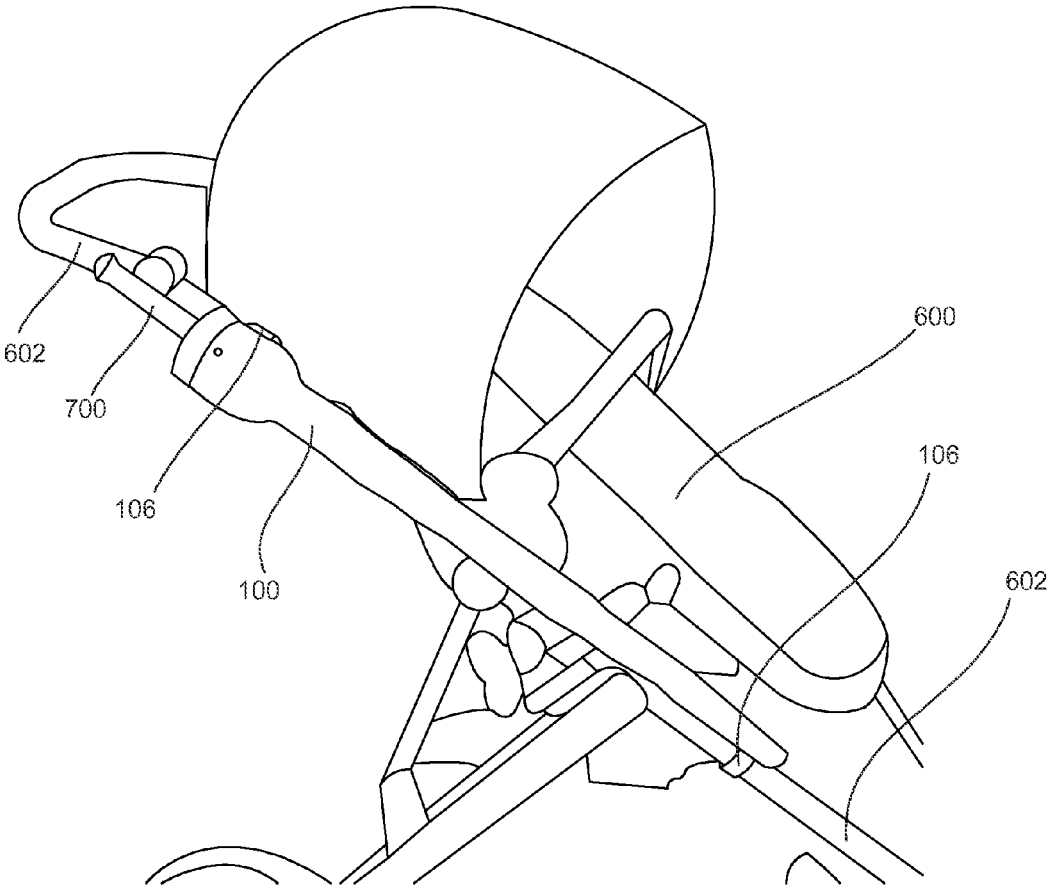
FIG. 7 depicts an embodiment of an umbrella case in use with a stroller and an umbrella.

FIG. 7 depicts an embodiment of the umbrella case 100 in use with a stroller 600 and an umbrella 700. A collapsed umbrella 700 can be at least partially inserted into the pouch 102. If the collapsed umbrella 700 entirely fits within the pouch 102, a user can position the enclosure member 104 over the handle of the umbrella 700 at the top end 110, and close the aperture of the top end 110 by securing the enclosure member 104 to the pouch 102 with the connectors 128.

If desired, a user can uncouple the connecting members 106 from the stroller's posts 602, and use the umbrella case 100 to store and/or transport a dry or wet umbrella 700 away from the stroller 600. If water has entered the interior of the pouch 102, the user can unfold the bottom end 108 and pour the water out of the aperture of the bottom end 108, out of the aperture of the top end 110 or, in some alternate embodiments, out of the outlet 120. In some embodiments, the umbrella case 100 can be used with devices other than strollers 600, such as shopping carts, bicycles, wheelchairs, rolling luggage, or any other device comprising components that can be coupled with the connecting members 106.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. An umbrella case, comprising:

a pouch defining an elongated receptacle having a bottom end and an top end;

an enclosure member coupled with said pouch at said top end; and one or more connecting members coupled with the exterior of said pouch at positions substantially following a straight line along a length of said pouch extending between said bottom end and said top end, wherein said pouch comprises a spinal member coupled with one or more body sections to form said pouch, said spinal member being an elongated strip extending along the length of said pouch from said bottom end to said top end, and said one or more body sections being coupled with one or more sides of said spinal member, wherein said top end defines a first aperture oriented substantially transversely to the length of said pouch, and wherein said bottom end defines a second aperture oriented substantially transversely to the length of said pouch.

2. The umbrella case of claim 1, wherein said connecting members are configured to be selectively coupled with one or more component of a separate device.

3. The umbrella case of claim 1, wherein said pouch is tapered from said top end to said bottom end.

4. The umbrella case of claim 1, wherein the length of said pouch is configured to be longer than the length of a collapsed umbrella.

5. The umbrella case of claim 1, wherein the length of said pouch is configured to be at least as long as the length of the canopy of a collapsed umbrella.

6. The umbrella case of claim 1, further comprising a plurality of corresponding fasteners coupled with the exterior of said pouch, wherein the length of said pouch is changed when two of said corresponding fasteners are mated.

7. The umbrella case of claim 1, wherein said one or more body sections are comprised of waterproof material.

8. The umbrella case of claim 1, wherein said one or more connecting members are each coupled with a side of said spinal member.

9. The umbrella case of claim 8, wherein:

said one or more connecting members are arranged in sets, each member of a set is configured to mate with the other member of the set, and one member of each set is coupled with a first side of said spinal member and the other member of each set is coupled with a second side of said spinal member, said first side and said second side being opposing edges of said spinal member that extend along the length of said pouch.

10. The umbrella case of claim 1, further comprising one or more collar members coupled with said top end and positioned transversely to the length of said pouch.

11. The umbrella case of claim 1, wherein at least one of said one or more connecting members comprises one or more fasteners.

12. The umbrella case of claim 1, wherein at least one of said one or more connecting members comprises one or more tightening mechanisms configured to adjust the position of at least one of said connecting members.

13. The umbrella case of claim 12, wherein at least one of said connecting members compresses the interior dimensions of said pouch when one or more of said tightening mechanisms is operated.

14. The umbrella case of claim 1, further comprising corresponding connectors coupled with said enclosure member and the exterior of said pouch, wherein said top end is covered by said enclosure member when said corresponding connectors are mated.

15. An umbrella case, comprising:

a pouch defining an elongated receptacle having a closed bottom end and an open top end;

an enclosure member coupled with said pouch at said open top end;

one or more connecting members coupled with the exterior of said pouch at positions substantially following a straight line along a length of said pouch extending between said closed bottom end and said open top end; and an outlet at said closed bottom end, wherein said pouch comprises a spinal member coupled with one or more body sections to form said pouch, said spinal member being an elongated strip extending along the length of said pouch from said bottom end to said top end, and said one or more body sections being coupled with one or more sides of said spinal member, and wherein said outlet is configured to be selectively opened from a closed state to expel water trapped in said pouch through said closed bottom end.

* * * * *